US009097032B1

(12) United States Patent
Al-Saffar

(10) Patent No.: US 9,097,032 B1
(45) Date of Patent: Aug. 4, 2015

(54) PORTABLE SHELTER

(71) Applicant: Abdulreidha A. J. A. Al-Saffar, Mubarak Al-Kabir (KW)

(72) Inventor: Abdulreidha A. J. A. Al-Saffar, Mubarak Al-Kabir (KW)

( * ) Notice: Subject to any disclaimer, the term of this patent is extended or adjusted under 35 U.S.C. 154(b) by 0 days.

(21) Appl. No.: 14/557,386

(22) Filed: Dec. 1, 2014

(51) Int. Cl.
*E04H 15/18* (2006.01)
*E04H 15/24* (2006.01)
*E04H 15/34* (2006.01)

(52) U.S. Cl.
CPC ..... *E04H 15/24* (2013.01); *E04H 15/34* (2013.01)

(58) Field of Classification Search
USPC ..... 135/97, 100, 135, 141, 157–160; 52/9.57, 79.5
See application file for complete search history.

(56) References Cited

U.S. PATENT DOCUMENTS

| | | | | | |
|---|---|---|---|---|---|
| 353,168 | A | * | 11/1886 | Shaw | 52/63 |
| 2,351,419 | A | * | 6/1944 | Fuller | 52/222 |
| 3,118,186 | A | * | 1/1964 | Moss | 52/71 |
| 3,134,200 | A | * | 5/1964 | Moss | 52/745.14 |
| 3,333,373 | A | * | 8/1967 | Taylor et al. | 52/63 |
| 3,996,706 | A | * | 12/1976 | Bomgaars | 52/71 |
| 4,265,261 | A | * | 5/1981 | Barker | 135/100 |
| 4,441,293 | A | | 4/1984 | McQueen et al. | |
| 4,640,061 | A | * | 2/1987 | Trumley | 52/71 |
| 4,726,153 | A | * | 2/1988 | Adler et al. | 52/63 |
| 5,651,220 | A | | 7/1997 | dit Felix | |
| 7,117,644 | B2 | * | 10/2006 | Dehart | 52/36.1 |
| 7,155,865 | B2 | * | 1/2007 | Rosenberg | 52/79.9 |
| 8,256,443 | B2 | * | 9/2012 | Neal | 135/96 |
| 8,479,464 | B2 | | 7/2013 | Holzworth | |
| 8,745,931 | B2 | | 6/2014 | Hutter | |
| 2004/0216395 | A1 | | 11/2004 | Wentworth, Jr. | |
| 2006/0048459 | A1 | * | 3/2006 | Moore | 52/79.1 |
| 2008/0110484 | A1 | * | 5/2008 | Doran | 135/121 |
| 2014/0034100 | A1 | | 2/2014 | Makos et al. | |
| 2014/0053481 | A1 | | 2/2014 | Leahy | |

* cited by examiner

*Primary Examiner* — Noah Chandler Hawk
(74) *Attorney, Agent, or Firm* — Richard C Litman

(57) ABSTRACT

The portable shelter includes a plurality of panels, each having a least one opening adapted to receive a support member configured to connect the panels in a vertical arrangement, at least one first receiving member coupled to each panel, the at least one first receiving member adapted to receive a first attachment member configured to connect the panels in a horizontal arrangement, a plurality of second receiving members, each adapted to receive a first end of an adjustable rod, the adjustable rod being selectively adjustable to a length corresponding to the configuration of the portable shelter, and a cone-shaped attachment member having a bottom portion including at least one ring of a plurality of apertures, each aperture adapted to receive a second end of the adjustable rod, the adjustable rod connecting the cone-shaped attachment to the plurality of panels, wherein the portable shelter can receive a first cover member.

11 Claims, 15 Drawing Sheets

PORTABLE SHELTER

BACKGROUND OF THE INVENTION

1. Field of the Invention

The present invention generally relates to temporary shelters, and more particularly to a portable shelter that provides a substantially expandable shelter having a connectable roof and a plurality of panels attached to one another to form a variety of desired configurations.

2. Description of the Related Art

Regardless of whether a person or a group of people are camping, hiking, or sightseeing in a warm, tropical touristic location or in a cold, snowy one, they need shelter not only for protection from the elements, but also for protection from the local wildlife. Typically, people use tents having a plastic/cloth covering, which normally does not insulate and protect people from the elements very well, since the plastic/cloth covering is not as durable as it should otherwise be. Further, the shape and size of the tent is fixed so that people using the tent are limited in their sleeping arrangements.

Thus, a portable shelter addressing the aforementioned problems is desired.

SUMMARY OF THE INVENTION

The portable shelter includes a plurality of panels, such as insulator panels, each panel having a least one opening adapted to receive a support member configured to connect the plurality of panels in a substantially vertical arrangement, and at least one first receiving member coupled to each panel, the at least one first receiving member being adapted to receive either a first attachment member having an angle in the range between 90° to 180°, inclusive, or a second attachment member having a first portion pivotally coupled to a second portion. The first attachment member and the second attachment member are each configured to connect the plurality of panels in a substantially horizontal arrangement. The portable shelter also includes a plurality of second receiving members, each second receiving member being adapted to receive a first end of an adjustable rod, the adjustable rod being selectively adjustable to a length corresponding to the configuration of the portable shelter, and a top member having a base including at least one ring of a plurality of apertures, each aperture being adapted to receive a second end of the adjustable rod, the plurality of adjustable rods being adapted to connect the top member to the plurality of panels, wherein the portable shelter is adapted to receive a first cover member selected from a group consisting of a tarp, a canopy, and an umbrella configured to protect against wind, water, and hot and cold weather.

The portable shelter can also include a second cover member positioned beneath the portable shelter. The second cover member has a hole adapted to dispose of trash that has accumulated inside the portable shelter. It is to be noted that the adjustable rod, such as a telescoping rod, can include a locking mechanism to substantially maintain the selectively adjustable length of each adjustable rod to correspond to the configuration of the portable shelter. Further, the first attachment member can include a first leg, a second leg, and a third leg, the third leg being configured to connect the first leg and the second leg, wherein the angle between the first leg and the second leg can range between 90° degrees to 180°, inclusive.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1A:
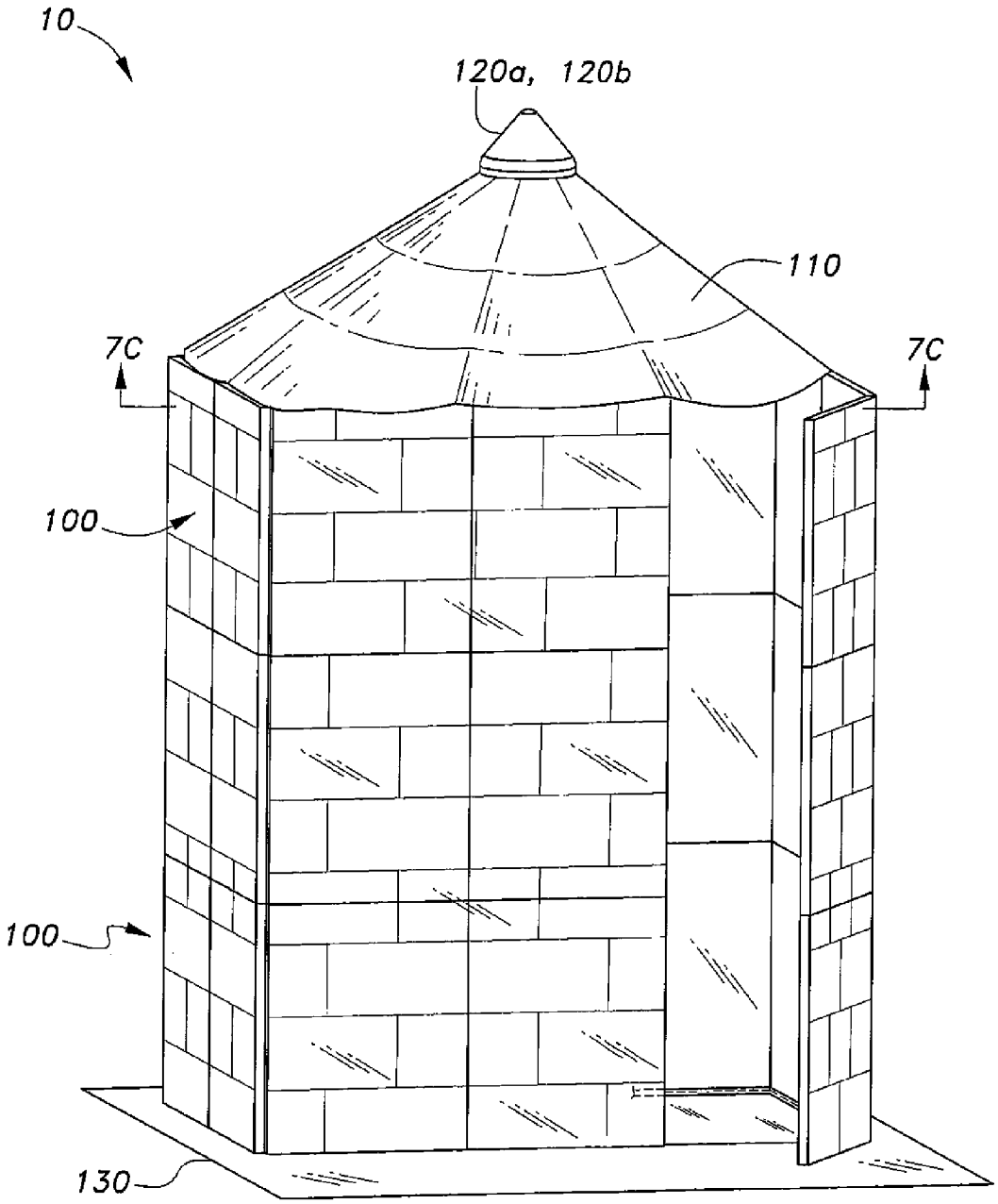
FIG. 1A is an environmental, front view of a portable shelter according to the present invention.
Figure 1B:
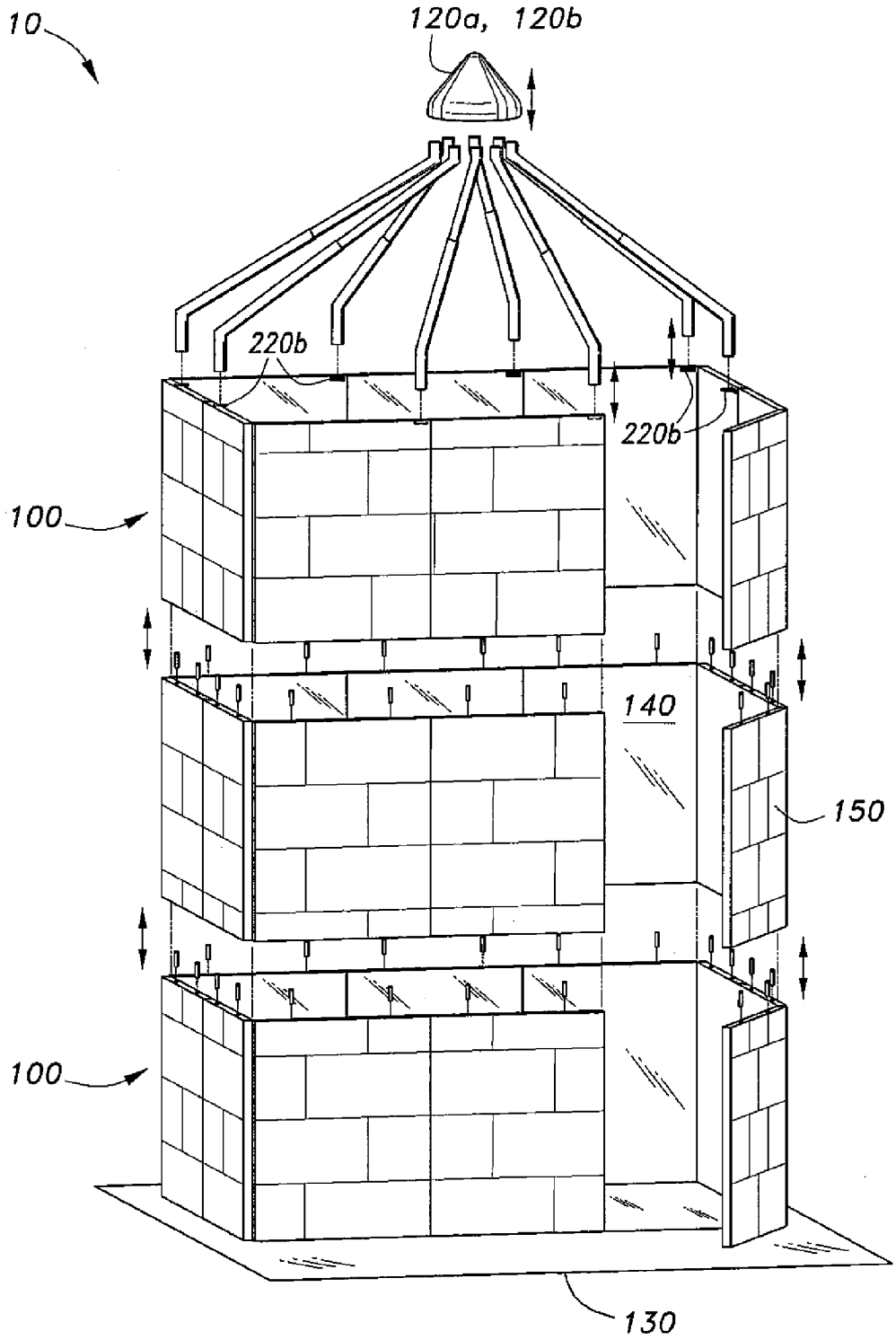
FIG. 1B is a partially exploded perspective view of the portable shelter of FIG. 1, the roof panels being omitted.
Figure 9A:
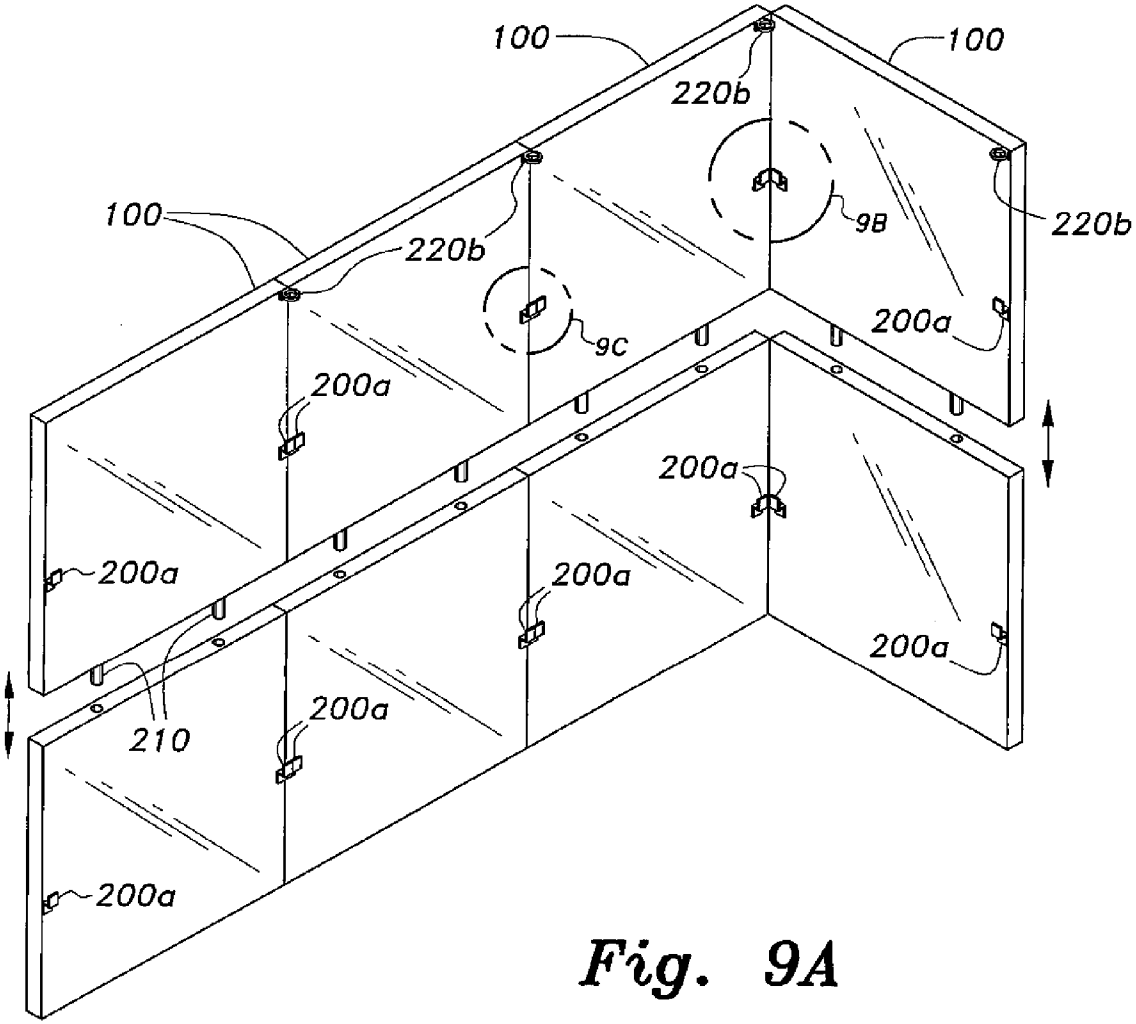
FIG. 9A is a partially exploded perspective view of a plurality of panels of a portable shelter according to the present invention.
Figure 9C:
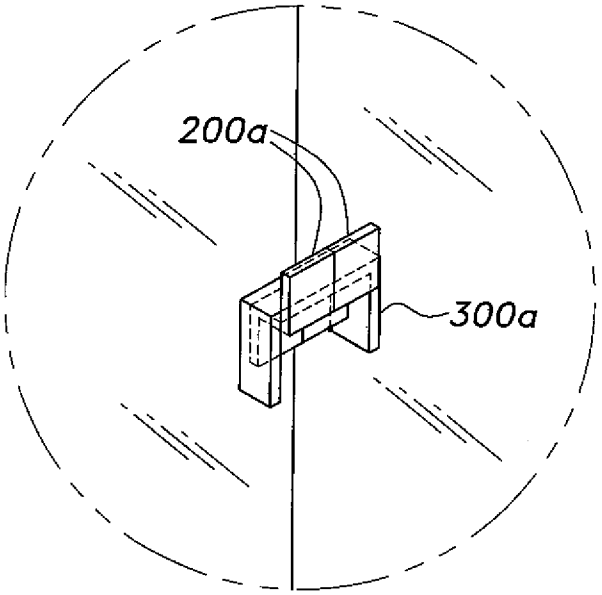
FIG. 9C is a detail view of area 9C of FIG. 9A.
Figure 9B:
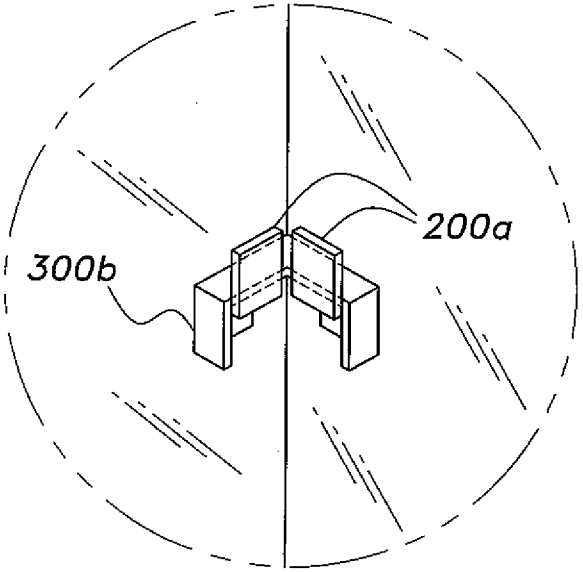
FIG. 9B is a detail view of area 9B of FIG. 9A.
Figure 10B:
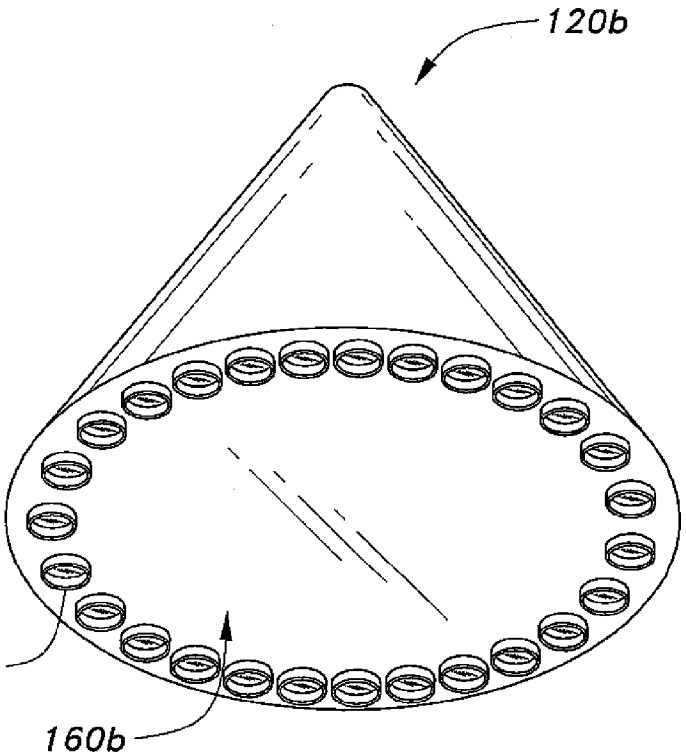
FIG. 10B is a bottom perspective view of a top member for a portable shelter according to the present invention, the top member having a base having a single ring of apertures defined therein.

Referring to FIGS. 1-11, the portable shelter 10 generally includes a plurality of panels 100, each panel 100 having at least one opening, such as openings 200*a*, 200*b* (see FIGS. 2A, 2B), adapted to receive a dowel, peg or support member 210 configured to join the plurality of panels 100 in a substantially upward, vertical arrangement, as illustrated in FIGS. 1A and 1B, at least one first receiving member 220*a* (such as a clip) adapted to receive either a first attachment member, such as first attachment member 300*a*, 300*b* (shown in FIGS. 3A and 3B, respectively), or a second attachment member 400 (shown in FIG. 4) configured to join the plurality of panels 100 in a substantially horizontal arrangement, (FIG. 9A), in order to form the walls of the portable shelter 10, at least one second receiving member 220*b* (such as a ring) adapted to receive an adjustable rod 700 (FIGS. 7A and 7B), and a top member, such as top members 120*a* (FIG. 10A), 120*b* (FIG. 10B).

Figure 5:
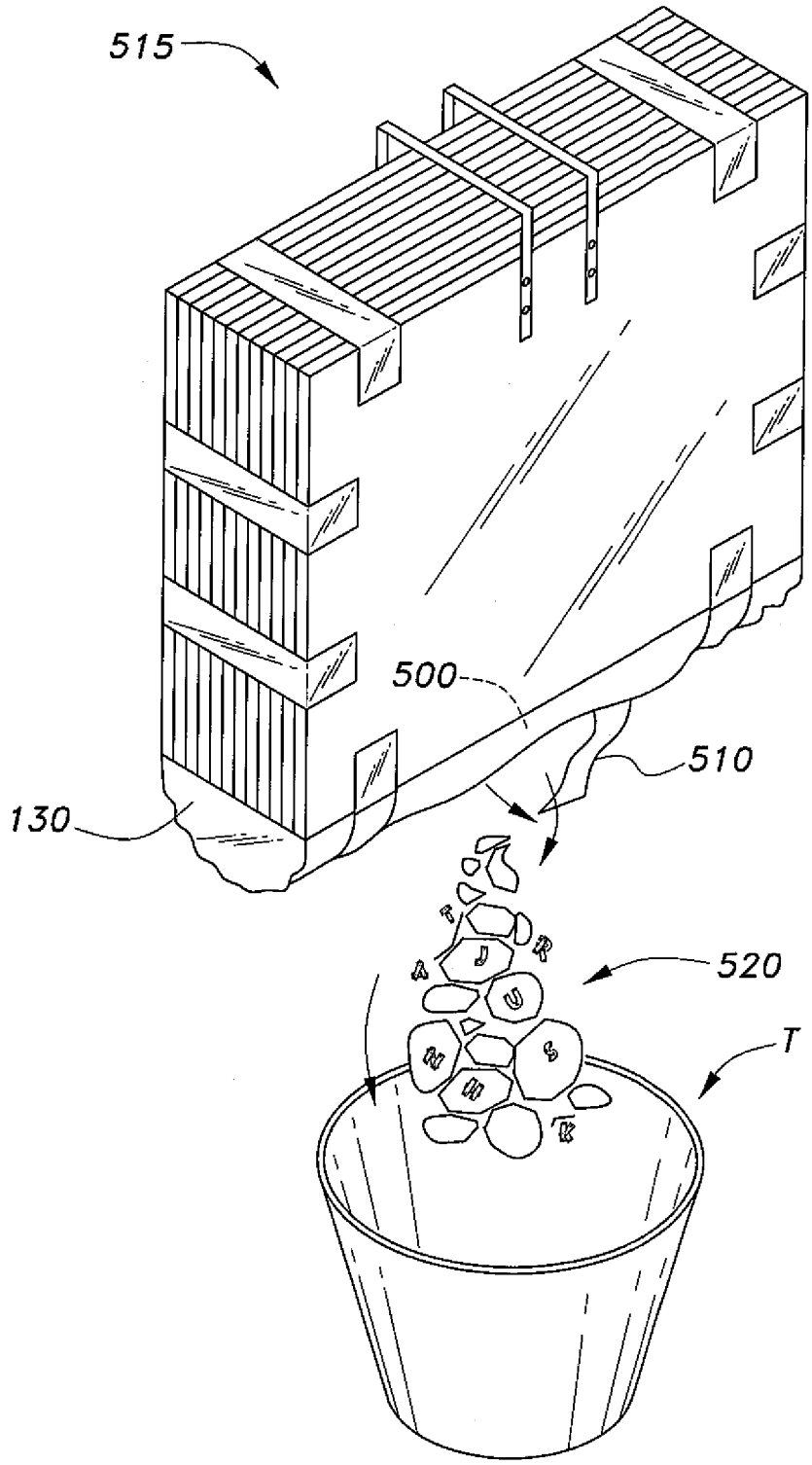
FIG. 5 is a perspective view of a portable shelter according to the present invention stored in a bag for storage and transport, the shelter having a second cover member including an opening to dispense trash.
Figure 6A:
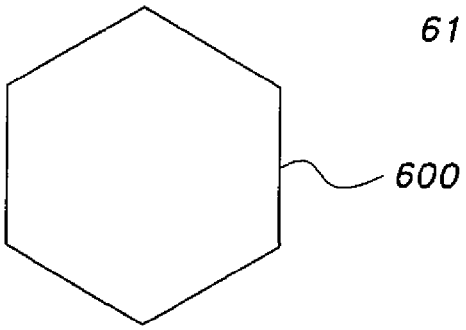
FIG. 6A illustrates a hexagon configuration for the portable shelter according to the present invention.
Figure 6B:
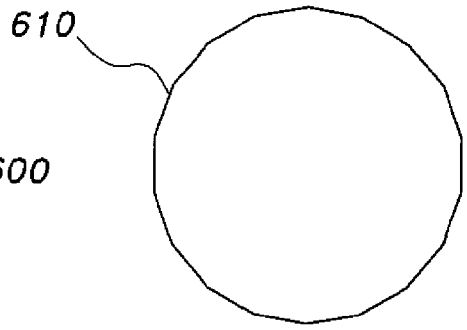
FIG. 6B illustrates a substantially circular configuration for the portable shelter according to the present invention.
Figure 6C:
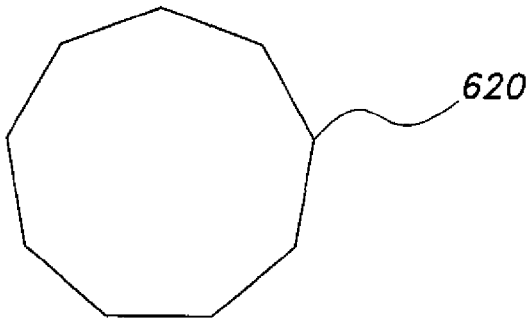
FIG. 6C illustrates a nonagon configuration for the portable shelter according to the present invention.
Figure 6D:
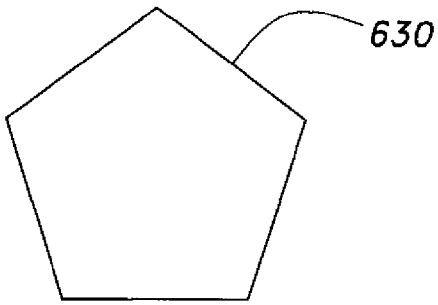
FIG. 6D illustrates a pentagon configuration for the portable shelter according to the present invention.
Figure 6E:
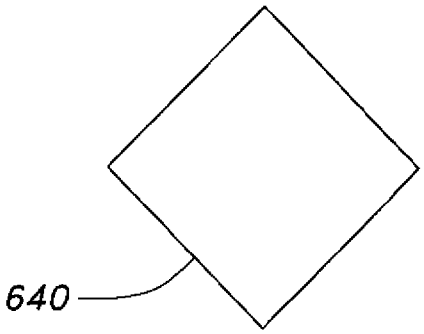
FIG. 6E illustrates a square configuration for the portable shelter according to the present invention.

The portable shelter 10 can be adapted to receive a first cover member 110, such as a tarp, canopy, or an umbrella, such as an auto-controlling umbrella, configured to cover the portable shelter 10 once the portable shelter 10 has been constructed. The first cover member 110 can have any suitable shape, such as a substantially rectangular shape, a substantially circular shape, a substantially square shape, or other suitable configuration, as illustrated in FIG. 1A. The first cover member 110 can be formed from any suitable material, such as plastic or cloth and can have any suitable thickness, such as 3 millimeters, to protect against wind, water, as well as hot and cold weather. Further, the portable shelter 10 can include a second cover member 130, such as a carpet, having any suitable size, such as having a length of 1 meter and a width of 1.5 meters, positioned beneath the portable shelter 10. The second cover member 130 can be affixed to the portable shelter 10 through the use of tape, glue, hook and loop fastener strips, or other suitable adhesive means, in order to prevent any insects or reptiles from entering into the portable shelter 10, as well as to prevent heat from escaping from the inside of the portable shelter 10. The second cover member 130 can also include a hole 500 of suitable size, such as having a length of 20 cm and a width of 20 cm, to dispose of trash 520, such as into a trash can T, that has accumulated inside the portable shelter 10, as illustrated in FIG. 5.

Figure 2A:
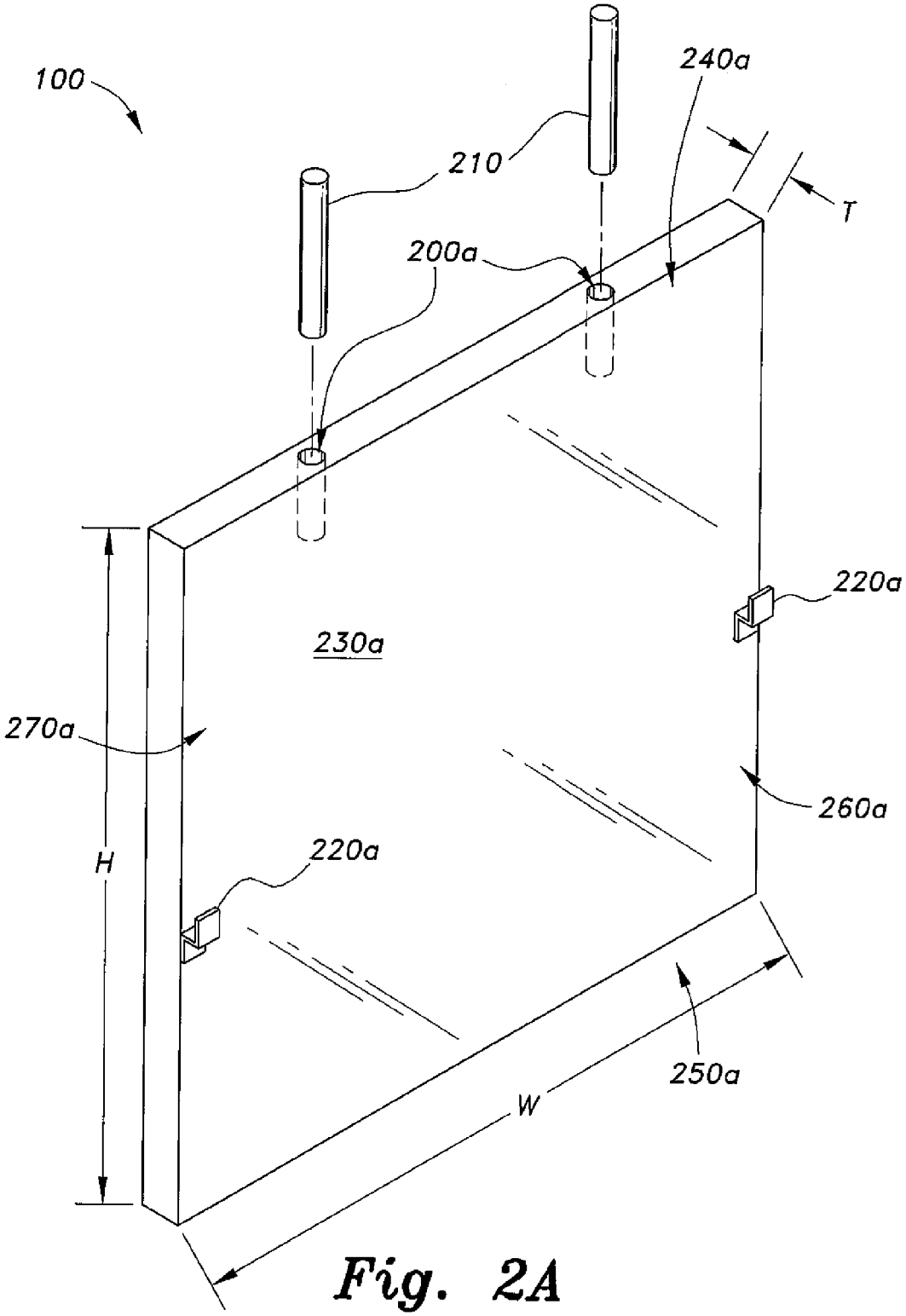
FIG. 2A is a perspective view of a panel for a portable shelter according to the present invention.
Figure 2C:
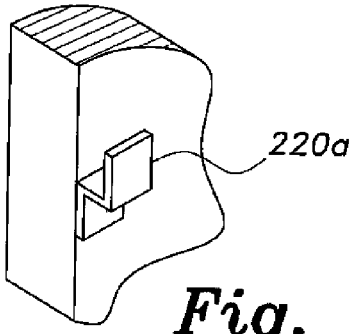
FIG. 2C is a detail view of area 2C of FIG. 2B.
Figure 2B:
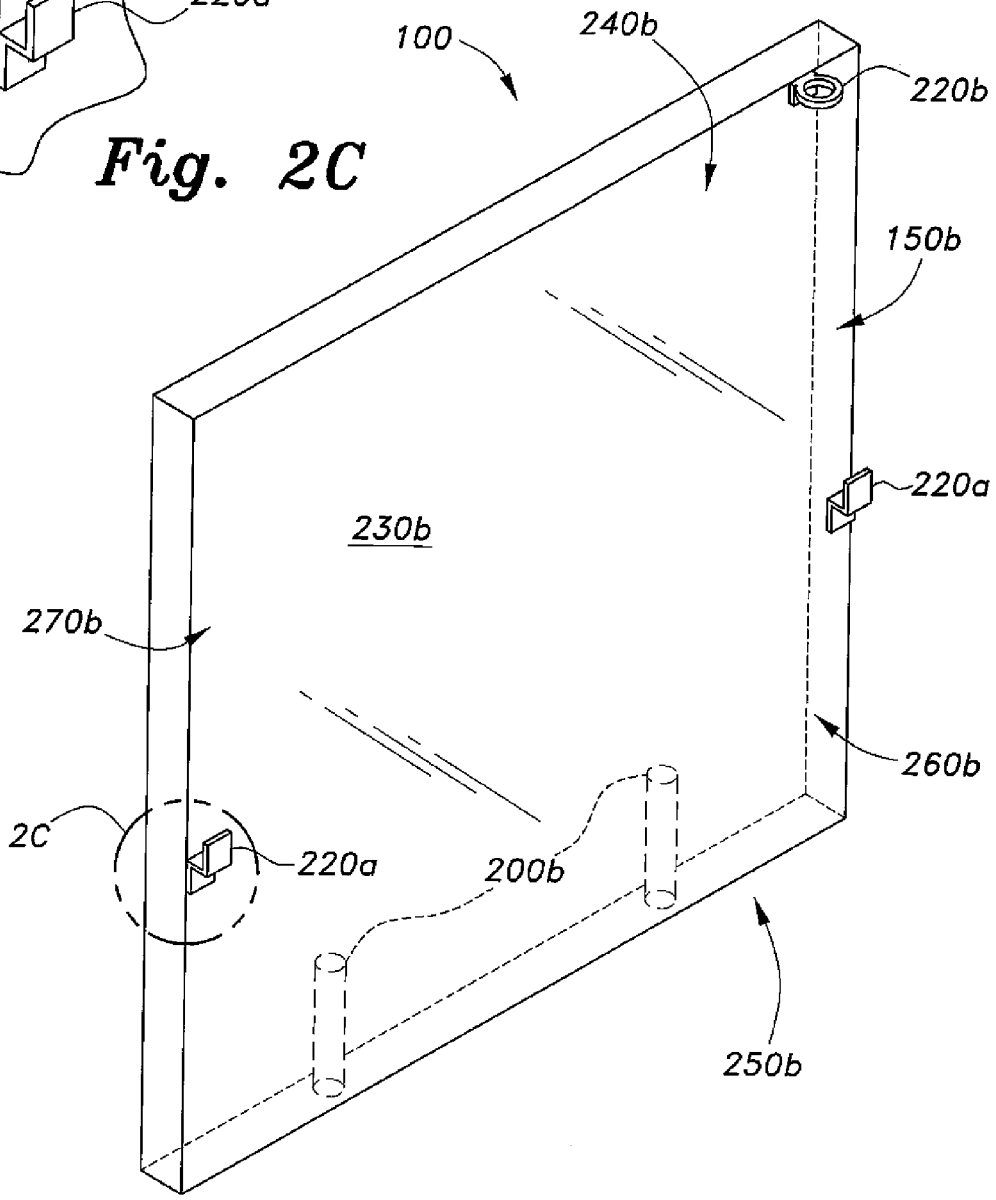
FIG. 2B is a perspective view of an alternative embodiment of a panel for a portable shelter according to the present invention.
Figure 3A:
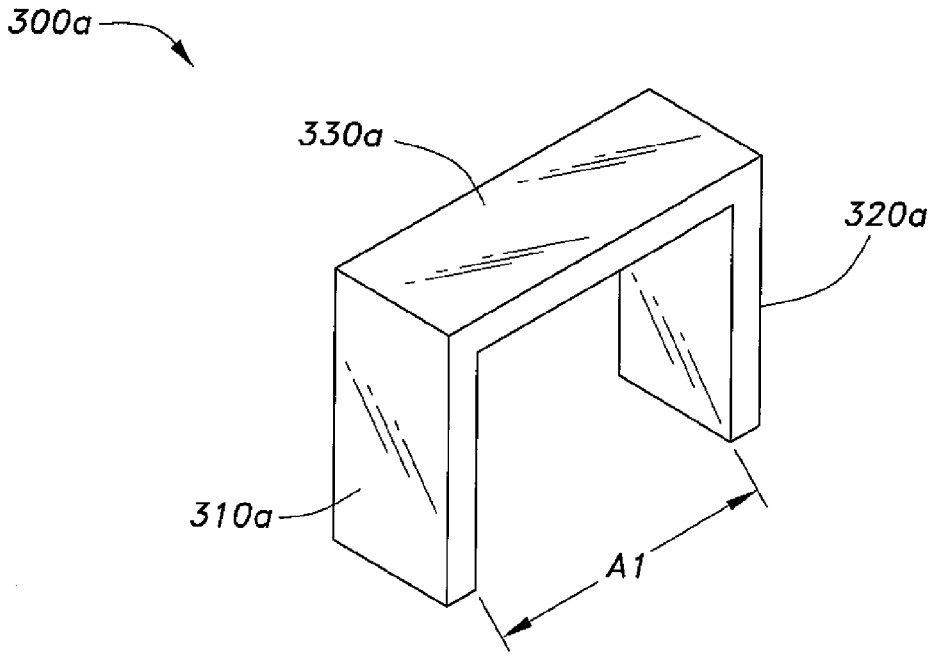
FIG. 3A is a perspective view of a first attachment member for a portable shelter according to the present invention.
Figure 3B:
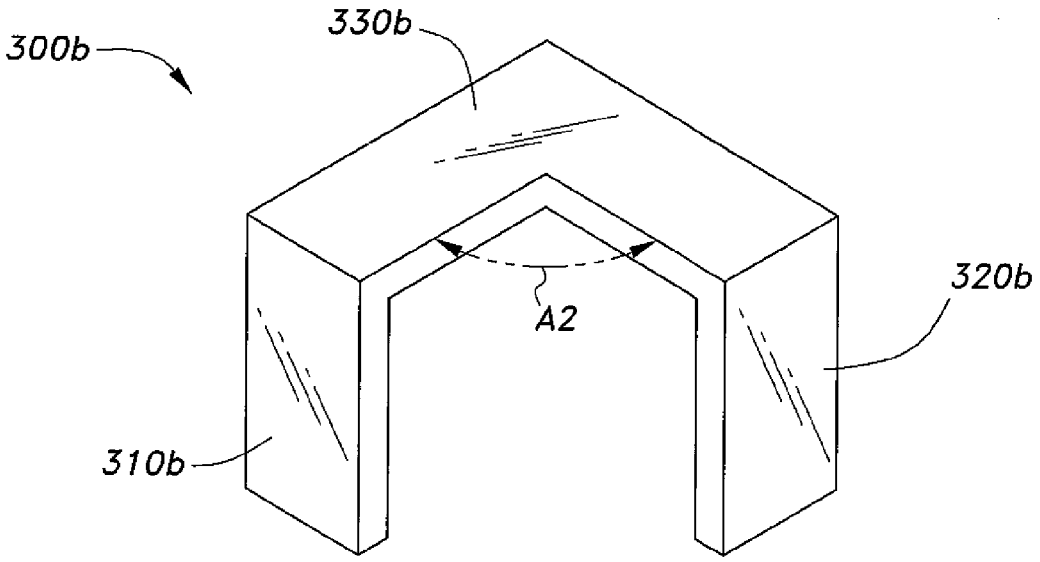
FIG. 3B is a perspective view of an alternative embodiment of a first attachment member for a portable shelter according to the present invention.
Figure 4:
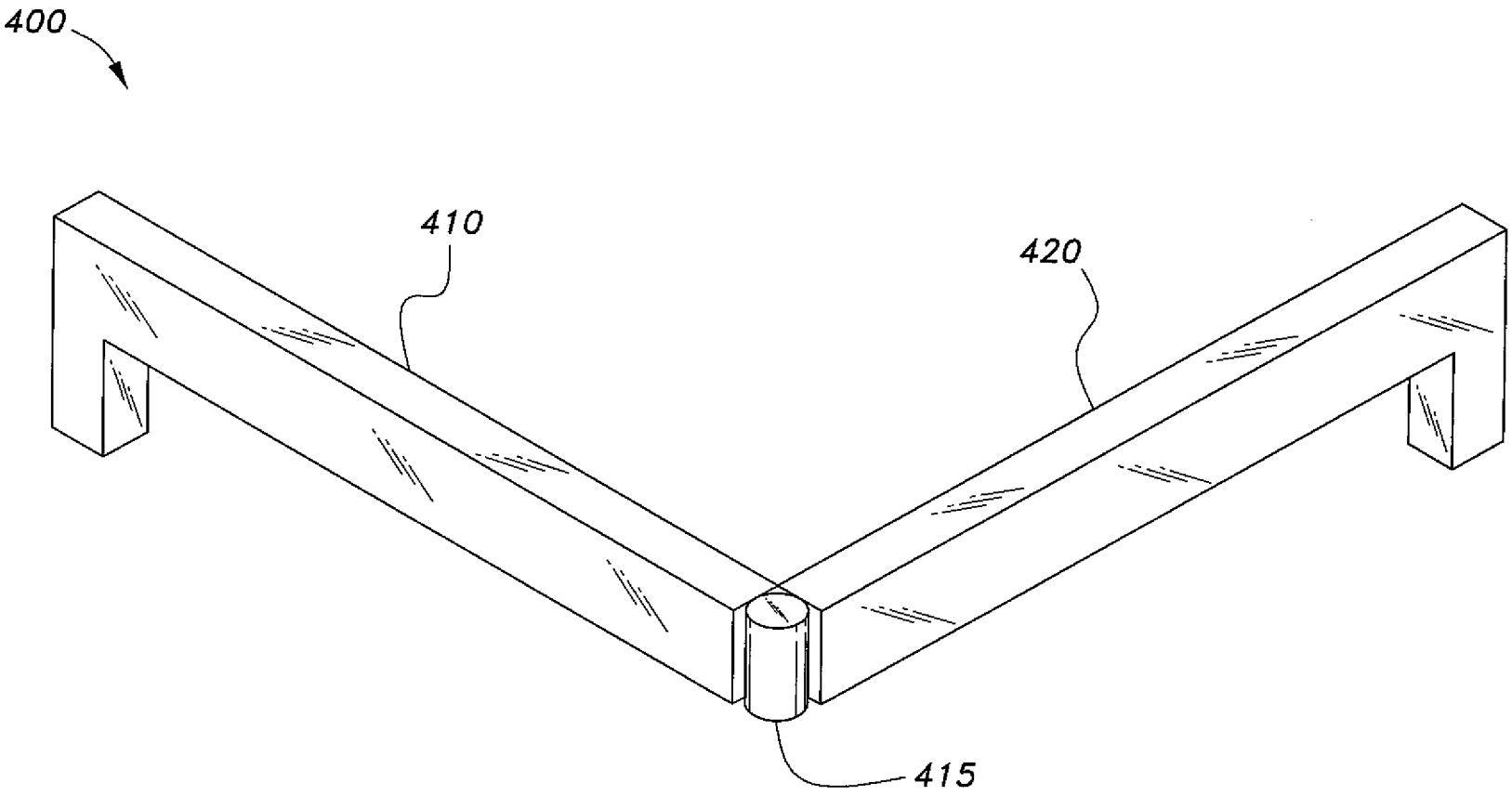
FIG. 4 is a perspective view of a second attachment member for a portable shelter according to the present invention.

Referring to FIGS. 2A, 2B, and 2C, the plurality of panels 100, such as insulated panels, can be divided into a first subset of panels 230*a* and a second subset of panels 230*b*. Each panel 100 in the first subset of panels 230*a* has a first top portion 240*a* including the at least one opening 200*a* adapted to receive the support member 210, a first bottom portion 250*a*, and a first right-side portion 260*a* and a first left-side portion 270*a*, each having the at least one first receiving member 220*a* adapted to receive either the first attachment member 300*a*, 300*b* or the second attachment member 400. Each panel 100 in the second subset of panels 230*b* has a second top portion 240*b* including the at least one second receiving member 220*b* adapted to receive the adjustable rod 700, a second bottom portion 250*b* including the at least one opening 200*b* adapted to receive the support member 210, and a second right-side portion 260*b* and a second left side portion 270*b*, each having the at least one first receiving member 220*a* adapted to receive the first attachment member 300*a*, 300*b*, or the second attachment member 400.

Each panel 100 can be formed from various suitable materials, such as foam and heat insulating cork with fiberglass, that provide suitable strength and durability to the portable shelter 10. Each of the plurality of panels 100 has an inner surface 140 and an outer surface 150 (FIG. 1B). The inner surface 140 of each panel 100 is typically the side of the panel 100 that faces inward, while the outer surface 140 of each panel 100 is typically the side of the panel 100 that faces outward. Moreover, the inner surface 150 of the panel 100 can include a plurality of different designs, such as the design 1100 illustrated in FIG. 11. Further, it is desirable that the at least one first receiving member 220*a* adapted to receive the first attachment member 300*a*, 300*b* or the second attachment member 400 be coupled to the inner surface 140 of each panel 100. Each panel 100 can be of any suitable size, such as having a width W of 50 cm, a height H of 60 cm, and a thickness T of 1 cm, and the corners of the panels 100 can be of various shapes, such as generally square shaped, as illustrated in FIGS. 2A and 2B.

Continuing with reference to FIGS. 2A, 2B, and 2C, the at least one opening 200*a*, 200*b* in the panels 100, such as in the first top portion 240*a* of each panel 100 in the first subset of panels 230*a* and in the second bottom portion 250*b* of each panel 100 in the second subset of panels 230*b* can be of any suitable size, such as having a depth of 10 cm, for example, adapted to receive the support member 210 configured to join the panels 100, such as the first top portion 240*a* and the second bottom portion 250*b*, together in a substantially vertical arrangement to form the walls of the portable shelter 10. Further, the support member 210 or dowel adapted to connect the panels 100 included in the first subset 230*a* to the panels 100 included in the second subset 230*b* can be formed from any suitable material, such as plastic, wood, and metal, such as steel, and can be of any suitable size, such as having a length of 20 cm and have a thickness of 4 mm, that can provide a suitable length and strength to support to the portable shelter 10.

Referring to FIGS. 3A, 3B, 9B, and 9C, the first attachment member 300*a*, 300*b* can be formed from any suitable material, such as wood, metal, and plastic, and can be configured to have an inverted "u" shape, so as to link the plurality of panels 100 in a horizontal arrangement to form a wall, such as forming a close-fitting wall. The first attachment member 300*a* can be configured to include a first leg 310, a second leg 320*a*, and a third leg 330*a* connecting the first leg 310*a* and the second leg 320*a*. The angle A1 between the first leg 310*a* and the second leg 320*a* can be 180°, i.e., the first leg 310*a* and the second leg 320*a* are parallel. Another embodiment of the first attachment member 300*b* can be configured to be include a first leg 310*b*, a second leg 320*b*, and a third leg 330*b* connecting the first leg 310*b* and the second leg 320*b* wherein the angle A2 between the first leg 310*b* and the second leg 320*b* is 90°, i.e., the first leg 310*b* and the second leg 320*b* are normal to each other. It is to be noted that the use of either first attachment member 300*a*, 300*b*, will depend on the desired configuration of the portable shelter 10.

Referring to FIGS. 4, 6A, 6B, 6C, 6D, and 6E, each second attachment member 400 includes a first portion 410 pivotally coupled to a second portion 420. The second attachment member 400 also includes a first hinge member 415 and can be configured to connect the panels 100 in a horizontal configuration. Each second attachment member 400 can be formed from any suitable material, such as wood, metal, and plastic to achieve a suitable configuration, such as a hexagon configuration 600, a substantially circular shape configuration 610, a nonagon configuration 620, a pentagon configuration 630, and a square configuration 640. Further, the second attachment member 400 can be configured to allow a least one panel 100 to rotate relating to another panel 100 in any desired direction, such as in the form of a door, for example. It is to be noted that when the second attachment member 400 is used to form a door, for example, the first attachment member 300*a*, 300*b* can be used as a door handle or other suitable gripping member.

Referring to FIGS. 7A, 7B, 7C, 8A, and 8B, each adjustable rod 700, such as a telescoping rod, can be made from any suitable material, such as plastic, metal, such as steel, and wood and can include an inner tube 710 having a first end 715 and an outer tube 720 having a second end 730. The inner tube 710 having a given diameter and an outer tube 720 having a diameter greater than the given diameter and can be configured to selectively expand and retract to achieve a given length L1, such as a length between 1 meter and 4 meters, sufficient to support the top member 120*a*, 120*b* positioned on top of the portable shelter 10, as illustrated in FIGS. 1A and 1B. Each adjustable rod 700 can be configured to include a locking mechanism to substantially prevent the corresponding adjustable rod 700 from substantially increasing or decreasing in length from a set position corresponding to an area to be covered by the first cover member 110. The inner tube 710 and the outer tube 720 can include at least one second hinge member 740, each second hinge member 740 having at least one first fastener 702 configured to substantially prevent the corresponding adjustable rod 700 from increasing or decreasing angle A3 and/or A4 corresponding to a height and configuration of the portable shelter 10. The at least one second hinge member 740 can include a shaft 707, having a suitable length, such as 5 cm, to couple the first end 715 of the adjustable rod 700 to the panels 100 and the second end 730 of the adjustable rod 700 to the aperture 180 of the first cover member 120*a*, 120*b*. The adjustable rod 700 can also include a second fastener 750*a*, 750*b* adapted to secure the attachment of the shaft 707 and the second end 730 of the adjustable rod 700 to the top member 120*a*.

Figures 7A, 7B, 7C:
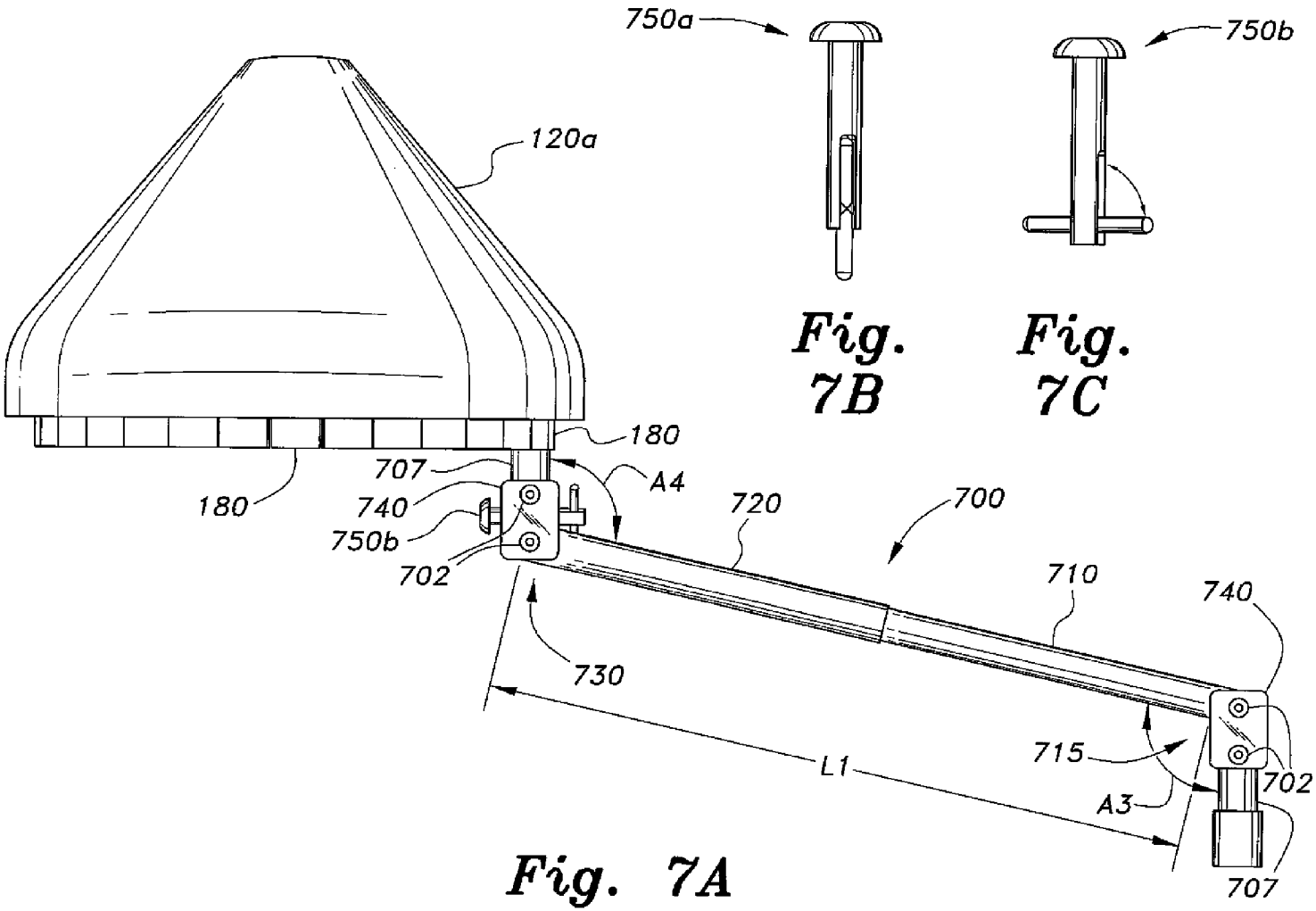
FIG. 7A is a view of an adjustable rod coupled to a top member of a portable shelter according to the present invention.
FIG. 7B is a front view of a second fastener for a portable shelter according to the present invention.
FIG. 7C is a front view of an alternative embodiment of a second fastener for a portable shelter according to the present invention.
Figure 8A:
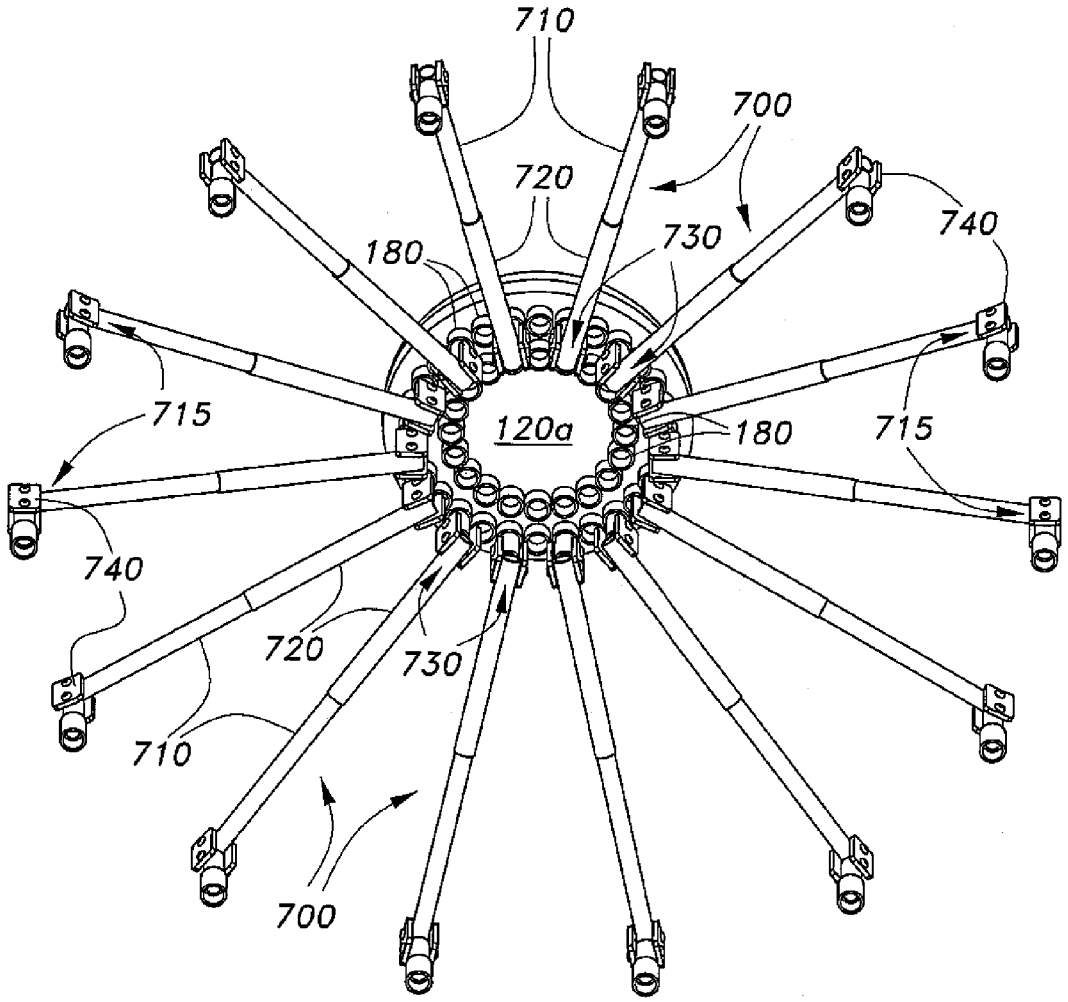
FIG. 8A is a bottom view of a top member for a portable shelter according to the present invention, shown coupled to a plurality of adjustable rods.
Figure 8B:
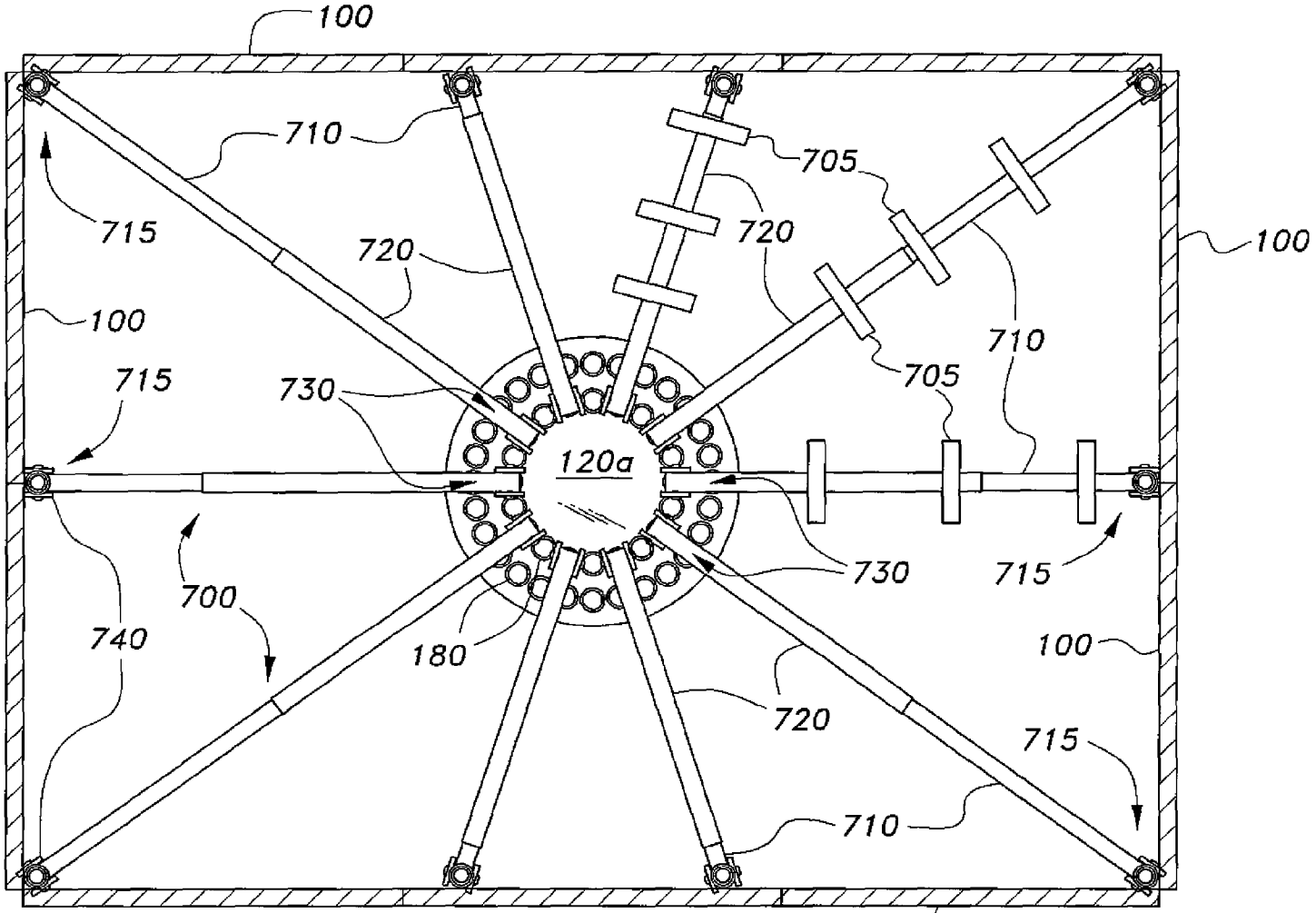
FIG. 8B is a bottom view of a top member for a portable shelter according to the present invention, shown in communication with a plurality of panels.
Figure 10A:
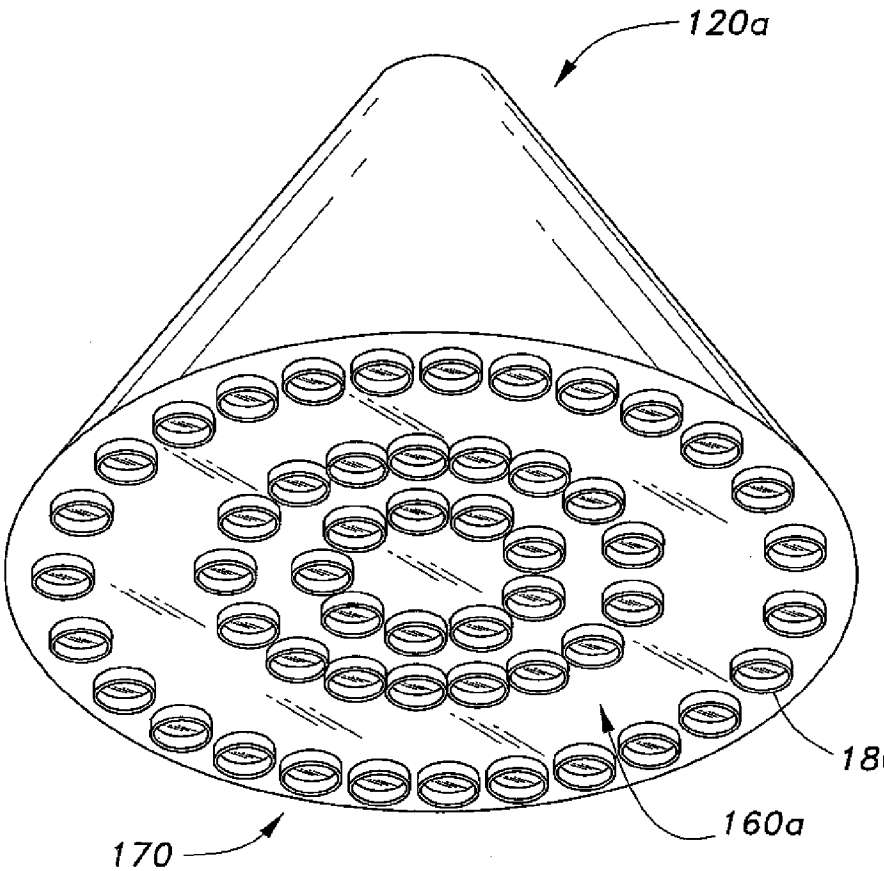
FIG. 10A is a bottom, perspective view of a top member for a portable shelter according to the present invention, the top member having a base having a plurality of rings of apertures defined therein.
Figure 11:
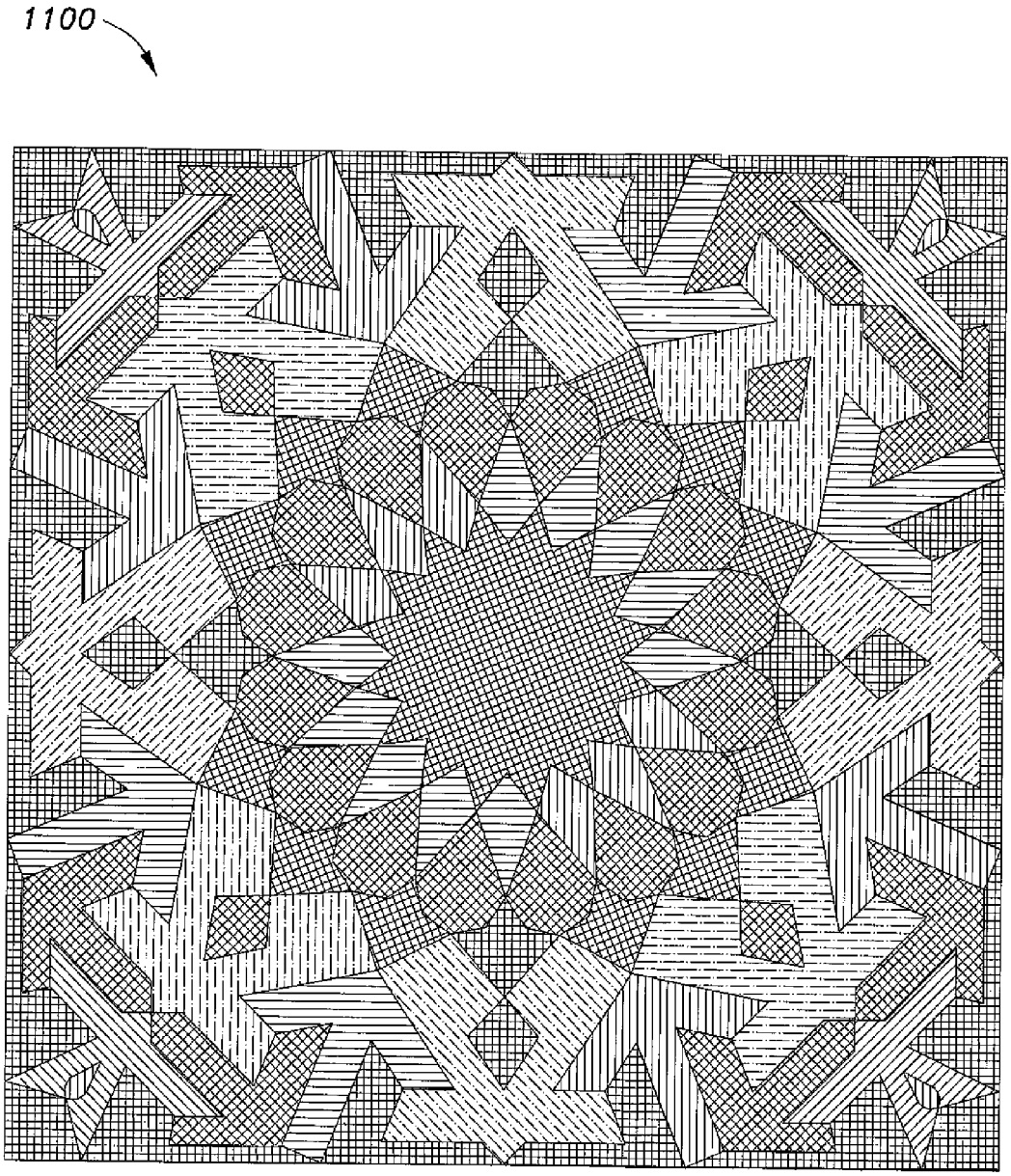
FIG. 11 is a front view of the inner surface of a panel for a portable shelter according to the present invention.

Referring to FIGS. 10A and 10B, the top member 120*a*, 120*b* can have any suitable shape, such as a cone-shape having a substantially circular base 160*a*, 160*b*. The base 160*a*, 160*b* of the top member 120*a*, 120*b*, may include at least one ring 170 of a plurality of apertures 180, each aperture 180 adapted to receive the second end 730 of the adjustable rod 700, as illustrated in FIG. 7A. The base 160*a*, 160*b* of the top member 120*a*, 120*b* can be of any suitable diameter and height, such as having a diameter of 20 cm and a height of 25 cm and can include a suitable number of apertures 180, such as 20 or 40, for example, depending on the desired size and configuration of the shelter 10. Consequently, depending on the desired size and configuration of the portable shelter 10 the number of apertures 180 utilized will vary. For example, if a small portable shelter 10 measuring 1 meter by 1.5 meters for two people is desired approximately ten apertures 180 will be utilized, whereas a portable shelter 10 for five people can require 40 apertures 180 to be utilized.

The first receiving member 220*a* configured to receive either the first attachment member 300*a*, 300*b* or the second attachment member 400 and the second receiving member 220*b* configured to receive the first end 715 of the adjustable rod 700 can be formed from any suitable material, such as wood, metal, and plastic. The first receiving member 220*a* can have any shape, such as an upside down "u" shape, for example, suitable to receive the first attachment members 300*a*, 300*b*, or the second attachment member 400 to support the plurality of panels 100 in one of a plurality of configurations, such as the hexagon configuration 600, the substantially circular shape configuration 610, the nonagon configuration 620, the pentagon configuration 630, and the square configuration 640. Further, the second receiving member 220*b* can have any shape, such as a substantially circular shape, suitable to receive the shaft 707 coupled to the first end 715 of an adjustable rod 700 to support the top member 120*a*, 120*b* and the first cover member 110 for the desired configuration, such as the configurations discussed above.

It is to be noted that one portable shelter 10 is typically designed for two people and includes approximately thirty panels 100. If the portable shelter 10 needs to be expanded to include additional individuals, a second shelter can typically be combined with the portable shelter 10 to increase the number of panels 10 from thirty to sixty. Additional shelters can be combined with one another to achieve a desired configuration and/or size. For example, a shelter 10 for three to four people will typically include sixty panels 10, whereas a shelter 10 for eight people can required 120 panels 10. Further, as the number of panels 10 increase so does the number of apertures 180 on the base 160*a*, 160*b* of the top member 120*a*, 120*b* used. It is to be noted that the configuration and the size of the portable shelter 10 can be configured for other uses, such as a warehouse for storage or as a covering for an outhouse, for example.

By way of operation, in order to transport the shelter 10 from one place to another, the portable shelter 10 should be disassembled and the panels 10, measuring 1 meter in length and 1.5 meters in width, for example, can be carried in the form of a bag 515, as illustrated in FIG. 5. Once the individual carrying the disassembled panels 100 of the portable shelter 10 arrives at the location where he/she will assemble the portable shelter 10, the panels 100 can be placed longitudinally on the ground. Subsequently, the first receiving members 220*a* are positioned and inserted into the inner surface 140, such as on the right-side portions 260*a*, 260*b* and the left-side portions 270*a*, 270*b* of each of the respective panels 100. The first attachment members 300*a*, 300*b* are inserted into the first receiving members 220*a* so as to link the panels 100 together in a substantially horizontal configuration to form a wall, as illustrated in FIGS. 9A, 9B, and 9C. It is to be noted that the second attachment member 400 can be use instead of a first attachment member 300*a*, 300*b* to achieve a variety of configurations, such as those illustrated in FIGS. 6A-6E, or a door.

After the panels 100 have been linked to one another in a substantially horizontal configuration to form a wall having a desired length, as illustrated in FIG. 9A, each support member 210 is inserted into the respective opening 200*a*, 200*b* on the panel 100 so that approximately half of the support member 210 can be inserted into the opening 200*a*, 200*b* of the panel 100 while the other half of the support member 210 protrudes or extends from the panel 100. The additional panels 100 can then be coupled onto the panels 100 in a substantially vertical arrangement, such as inserting the portion of the support member 210 extending or protruding from the opening 200*a*, 200*b* of one panel 100 into the corresponding opening 200*a*, 200*b* of another panel 100, as illustrated in FIG. 9A, until a wall having a desired height, such as 120 cm, has been constructed. It is to be noted that panels 100 can be configured to contain openings, such as openings 200*a*, 200*a*, on the top portion, such as top portions 240*a*, 240*b*, and on the bottom portion, such as bottom portions 250*a*, 250*b*, so that they can be used in connection with the support members 210 to achieve a wall of a desired height, such as having three panels 100 coupled together in a substantially vertical arrangement, as illustrated in FIGS. 1A and 1B. Accordingly, depending on the desired height and the size of the portable shelter 10, the number of panels 100 can vary.

Once the desired vertical height of the walls of the shelter 100 has been achieved, the sides of the panels 100 can be coupled to one another, such as by aligning the first receiving members 220*a* positioned on the right-side portion 260*a*, 260*b* on the panels 100 with the first receiving members 220*a* positioned on the left-side portion 270*a*, 270*b* of the panels 100 and inserting either the first attachment member 300*a* or 300*b* or the second attachment member 400 to form a suitable configuration, such as the hexagonal configuration 600, the substantially circular configuration 610, the nonagonal configuration 620, the pentagonal configuration 630, and the square configuration 640.

It is to be noted that after the panels 100 have been attached and the desired configuration constructed, a second cover member 130, such as a floor carpet, having length of 1 meter and width of 1.5 meters, can be placed beneath the portable shelter 10, such as between the ground and the panels 100 and secured to a portion of the panels, such as the first bottom portion 250*a* of the panels 100 in the first subset 230*a*, by a suitable attaching means such as hook and loop fasteners, adhesive tape, or glue to insulate the portable shelter 10, as well as to prevent insects or other reptiles from entering the portable shelter 10 from the outside. The hole 500 in the second cover member 130, having a suitable size, such as having a length of 20 cm and a width of 20 cm, can then be used to dispose of trash 520 into the trash can T, as illustrated in FIG. 5. The hole 500 can be created by a flap 510 permanently attached to the second cover member 130 at one end and removably attached to the second cover member 130 on three other sides, such as with suitable attaching means, such as double-sided tape.

After the walls of the portable shelter 10 have been constructed, as illustrated in FIGS. 1A and 1B, and the second cover member 130 has been secured beneath the portable shelter 10, an adjustable rod 700 is coupled to the second receiving member 220*b*, such as by inserting the shaft 707 of the first end 715 of the adjustable rod 700 into one of the second receiving members 220*b* positioned on the inner surface 140 of the panel 100, such as on the second top portion 240*b* of the panel 100 in the second subset of panels 230*b*. The number of adjustable rods 700 used and their corresponding lengths will depend on the desired configuration of the portable shelter 10. Subsequently, the top member 120*a*, 120*b* is coupled to the adjustable rod 700, such as by inserting the shaft 707 coupled to the second end 730 of the adjustable rod 700 into the corresponding aperture 180 on the base 160*a*, 160*b* of the top member 120*a*, 120*b*. It is to be noted that, as discussed above, the number of apertures 180, positioned on the base 160*a*, 160*b* of the second attachment member 120*a*, 120*b*, used will depend on the size and configuration of the desired portable shelter 10. After the top member 120*a*, 120*b* has been connected to the adjustable rods 700 and the lengths L1 of the adjustable rods 700 have been selectively set so as to connect with the panels 100, the first cover member 110 is then positioned on top of the adjustable rods 700 so as to prevent rain, sunlight, or insects, for example, from entering the portable shelter 10, as illustrated in FIG. 1A. The first cover member 110 can be secured to the adjustable rods 700 by an adhesive means 705, such as tape, hook and loop fastener straps, or any suitable means.

It is important to note that not all panels 100 have to be used. For example, if an individual would like a window for ventilation, then he/she can remove a panel 100 from the wall. Further, instead of using the first attachment members 300*a*, 300*b*, the second attachment member 400 can be used to enable the relative swinging movement between the panels 100, such as for a door for the shelter 10, as illustrated in FIG. 1A.

It is to be understood that the present invention is not limited to the embodiments described above, but encompasses any and all embodiments within the scope of the following claims.

I claim:

1. A portable shelter, comprising:

a plurality of panels, each of the panels having a least one opening adapted to receive a support member configured to connect the plurality of panels in a substantially vertical arrangement;

wherein each one of the plurality of panels includes an outer surface, an inner surface, and a perimeter surface, the inner surface and the outer surface are parallel and spaced apart by a spacing defined by a predetermined distance therebetween, and the perimeter surface circumscribes the spacing between the inner surface and outer surface;

at least one first receiving member coupled to each of the panels;

at least one first attachment member;

the at least one first receiving member being adapted to receive a portion of the at least one first attachment member, whereby at least one first attachment member is designed and configured to connect the plurality of panels via the at least one first receiving member, in a substantially horizontal arrangement;

wherein each of the at least one first receiving member being disposed on the inner surface;

a plurality of second receiving members attached to the panels;

wherein each of the second receiving members is disposed along the perimeter surface;

an adjustable rod, each of the second receiving members being adapted to receive a first end of the adjustable rod, the adjustable rod being selectively adjustable to a length corresponding to the configuration of the portable shelter; and a top member having a base including at least one ring of a plurality of apertures, each of the apertures being adapted to receive a second end of the adjustable rod, the plurality of adjustable rods forming a cone-shaped frame;

a cone-shaped cover attached to the cone-shaped frame.

2. The portable shelter according to claim 1 further comprising at least one second attachment member having a first portion pivotally coupled to a second portion, the at least one second attachment member pivotally connecting at least two of the panels.

3. The portable shelter according to claim 1 further comprising a second cover member having a hole adapted to dispose of trash that has accumulated inside the portable shelter.

4. The portable shelter according to claim 1, wherein the plurality of panels comprises:

a distinct first subset of panels including panels having a first top portion having at least one opening adapted to receive the support member, a first bottom portion, and a first right-side portion and a first left-side portion, each first right-side portion and first left-side portion including the at least one first attachment member, and a distinct second subset of panels including panels having a second top portion including at least one second attachment member, a second bottom portion having the at least one opening adapted to receive the support member, and a second right-side portion and a second left-side portion, each second right-side portion and second left-side portion including at least one first attachment member.

5. The portable shelter according to claim 1, wherein the plurality of panels comprise a plurality of insulator panels.

6. The portable shelter according to claim 1, wherein the adjustable rod comprises a telescoping rod.

7. The portable shelter according to claim 6, wherein each of the plurality of adjustable rods further comprises a locking mechanism to substantially maintain the selectively adjustable length of each of the adjustable rod to correspond to the configuration of the portable shelter.

8. The portable shelter according to claim 1, wherein the cone-shaped cover is selected from the group consisting of a tarp, a canopy, and an umbrella.

9. The portable shelter according to claim 1, wherein the first attachment member comprises a first leg and a second leg extending normal to the first leg.

10. The portable shelter according to claim 1, wherein the first attachment member comprises a first leg, a second leg, and a third leg configured in an inverted U-shape.

11. The portable shelter according to claim 1, wherein the top member comprises a cone.

* * * * *